US012564915B2

(12) United States Patent
Fabian et al.

(10) Patent No.: US 12,564,915 B2
(45) Date of Patent: Mar. 3, 2026

(54) ABRASIVE FLUID JET WITH RECYCLING SYSTEM FOR ABRASIVES AND METHODS OF USE OF SAME

(71) Applicant: Flow International Corporation, Kent, WA (US)

(72) Inventors: Timothy R. Fabian, Geneva, IL (US); Mohamed Hashish, Bellevue, WA (US); Timothy J. Drinnon, Des Moines, WA (US); Sean R. Schramm, Buckley, WA (US)

(73) Assignee: Flow International Corporation, Kent, WA (US)

( * ) Notice: Subject to any disclaimer, the term of this patent is extended or adjusted under 35 U.S.C. 154(b) by 410 days.

(21) Appl. No.: 17/976,576

(22) Filed: Oct. 28, 2022

(65) Prior Publication Data

US 2023/0136030 A1 May 4, 2023

Related U.S. Application Data

(60) Provisional application No. 63/274,885, filed on Nov. 2, 2021.

(51) Int. Cl.

| | |
|---|---|
| ***B24C 9/00*** | (2006.01) |
| ***B24C 1/04*** | (2006.01) |
| ***B24C 7/00*** | (2006.01) |

(52) U.S. Cl.

CPC ..... *B24C 9/006* (2013.01); *B24C 1/045* (2013.01); *B24C 7/0023* (2013.01)

(58) Field of Classification Search

CPC ..... B24C 9/00; B24C 1/045; B24C 7/0023; B24C 7/00; B24C 7/0007; B24C 9/006;

(Continued)

(56) References Cited

U.S. PATENT DOCUMENTS 3,984,943 A 10/1976 Kono et al.
4,202,142 A 5/1980 Van (Continued)

FOREIGN PATENT DOCUMENTS

CN 209868331 U 12/2019
CN 211439598 U 9/2020

(Continued)

OTHER PUBLICATIONS

International Search Report and Written Opinion for PCT/US2022078907, mailed Mar. 7, 2023, 15 pages.

(Continued)

*Primary Examiner* — Monica S Carter
*Assistant Examiner* — Kent N Shum
(74) *Attorney, Agent, or Firm* — Cozen O'Connor

(57) ABSTRACT

Disclosed herein are components, systems, and methods of operating an abrasive fluid jet system that recycles and reuses abrasive particles for multiple cycles. The systems and methods include adjusting one or more operating parameters of the abrasive fluid jet system to compensate for a reduction in cutting power of the used abrasives as the used abrasive particles are continuously discharged from the outlet of the cutting head across multiple cycles. The one or more operating parameters include fluid pressure that forms the fluid jet, a cutting speed of the cutting head, and flow rate of abrasive particles, which are changeable while continuing to operate the abrasive fluid jet system. The one or more operating parameters include an orifice size through which a fluid passes to generate the second fluid jet, a mixing tube diameter through which the second abrasive fluid jet passes, and a length of the mixing tube.

16 Claims, 10 Drawing Sheets

(58) Field of Classification Search
CPC .. B24C 11/00; B24C 1/06; B24C 3/04; B24C 7/0015; B24C 7/0038; B24C 7/0076; B24C 7/0084; Y02P 70/10
See application file for complete search history.

(56) References Cited

U.S. PATENT DOCUMENTS

| | | | | |
|---|---|---|---|---|
| 4,669,230 | A * | 6/1987 | Suzuki | B24C 7/0092 451/100 |
| 4,872,293 | A | 10/1989 | Yasukawa et al. | |
| 5,035,089 | A | 7/1991 | Tillman et al. | |
| 5,468,174 | A | 11/1995 | Bachand et al. | |
| 5,545,074 | A | 8/1996 | Jacobs | |
| 5,562,531 | A | 10/1996 | Yamaharu | |
| 5,643,058 | A | 7/1997 | Erichsen et al. | |
| 5,827,114 | A | 10/1998 | Yam et al. | |
| 6,224,463 | B1 | 5/2001 | Hartzell | |
| 6,299,510 | B1 | 10/2001 | Massenburg | |
| 6,328,638 | B1 | 12/2001 | Hopkins et al. | |
| 6,361,416 | B1 | 3/2002 | Hopkins et al. | |
| 6,766,216 | B2 | 7/2004 | Erichsen et al. | |
| 6,805,618 | B1 | 10/2004 | Ward et al. | |
| 6,875,084 | B2 | 4/2005 | Hashish et al. | |
| 7,147,545 | B2 | 12/2006 | Gadd | |
| 8,277,277 | B2 | 10/2012 | Mase et al. | |
| 8,308,525 | B2 | 11/2012 | Hashish et al. | |
| 8,764,513 | B1 | 7/2014 | Spears | |
| 9,011,204 | B2 | 4/2015 | Raghavan et al. | |
| 9,440,370 | B2 | 9/2016 | Hayden | |
| 9,579,773 | B2 | 2/2017 | Adams | |
| 10,478,944 | B2 | 11/2019 | Mestanek et al. | |
| 11,224,987 | B1 | 1/2022 | Guglielmetti | |
| 11,577,366 | B2 | 2/2023 | Schubert et al. | |
| 11,872,670 | B2 | 1/2024 | Schubert et al. | |
| 2002/0004356 | A1 * | 1/2002 | Wern | B24C 9/006 451/36 |
| 2002/0195424 | A1 * | 12/2002 | Tanaka | B24B 37/04 216/84 |
| 2003/0037650 | A1 | 2/2003 | Knaupp et al. | |
| 2006/0223422 | A1 * | 10/2006 | Dorfman | B24C 5/04 451/38 |
| 2007/0037495 | A1 | 2/2007 | Matsubara et al. | |
| 2010/0124872 | A1 * | 5/2010 | Hashish | B24C 5/02 451/75 |
| 2014/0331567 | A1 * | 11/2014 | Takahashi | C02F 1/5236 51/298 |
| 2015/0093969 | A1 * | 4/2015 | Mase | B24C 9/006 118/712 |
| 2018/0161958 | A1 * | 6/2018 | Schubert | B24C 7/0023 |
| 2019/0084125 | A1 | 3/2019 | Nambiath et al. | |
| 2019/0210188 | A1 * | 7/2019 | Pastori | B24C 9/006 |
| 2020/0122295 | A1 | 4/2020 | Lerea et al. | |
| 2021/0154799 | A1 | 5/2021 | Dean et al. | |

FOREIGN PATENT DOCUMENTS

| | | | |
|---|---|---|---|
| CN | 111906696 | B | 12/2021 |
| EP | 0119338 | A1 | 9/1984 |
| JP | H05177546 | A | 7/1993 |
| JP | H07124865 | A | 5/1995 |
| WO | 9817439 | A2 | 4/1998 |
| WO | 2020237804 | A1 | 12/2020 |

OTHER PUBLICATIONS

International Search Report and Written Opinion for PCT/US2023/077601 mailed Mar. 14, 2024, 19 pages.
Notice of Allowance for U.S. Appl. No. 17/975,407, mailed Jul. 14, 2025, 26 pages.
EP Search Report mailed Sep. 16, 2025, in EP App No. 22890959.4. 11 pages.

* cited by examiner

| SIZE/CYCLE | R0 | R1 | R2 | R3 | R4 | R5 | R6 | R7 | R8 | R9 |
|---|---|---|---|---|---|---|---|---|---|---|
| CYCLE 1 | 100% | 0% | 0% | 0% | 0% | 0% | 0% | 0% | 0% | 0% |
| CYCLE 2 | 10% | 90% | 0% | 0% | 0% | 0% | 0% | 0% | 0% | 0% |
| CYCLE 3 | 10% | 10% | 80% | 0% | 0% | 0% | 0% | 0% | 0% | 0% |
| CYCLE 4 | 10% | 10% | 10% | 70% | 0% | 0% | 0% | 0% | 0% | 0% |
| CYCLE 5 | 10% | 10% | 10% | 10% | 60% | 0% | 0% | 0% | 0% | 0% |
| CYCLE 6 | 10% | 10% | 10% | 10% | 10% | 50% | 0% | 0% | 0% | 0% |
| CYCLE 7 | 10% | 10% | 10% | 10% | 10% | 10% | 40% | 0% | 0% | 0% |
| CYCLE 8 | 10% | 10% | 10% | 10% | 10% | 10% | 10% | 30% | 0% | 0% |
| CYCLE 9 | 10% | 10% | 10% | 10% | 10% | 10% | 10% | 10% | 20% | 0% |
| CYCLE 10 | 10% | 10% | 10% | 10% | 10% | 10% | 10% | 10% | 10% | 10% |
| CYCLE 11 | 10% | 10% | 10% | 10% | 10% | 10% | 10% | 10% | 10% | 10% |
| CYCLE 12 | 10% | 10% | 10% | 10% | 10% | 10% | 10% | 10% | 10% | 10% |
| CYCLE 13 | 10% | 10% | 10% | 10% | 10% | 10% | 10% | 10% | 10% | 10% |

FIG. 10

ABRASIVE FLUID JET WITH RECYCLING SYSTEM FOR ABRASIVES AND METHODS OF USE OF SAME

BACKGROUND

Technical Field

This disclosure relates to fluid jet systems and related methods, and more particularly, to the use of abrasive fluid jet systems that process workpieces and that recycle used abrasives for repeat use.

Description of the Related Art

Waterjet or abrasive waterjet cutting systems are used for cutting a wide variety of materials, including stone, glass, ceramics, and metals. In a typical waterjet cutting system, high-pressure water flows through a cutting head having a nozzle which directs a cutting jet onto a workpiece. The system may draw or feed abrasive media into the high-pressure waterjet to form a high-pressure abrasive waterjet. One or both of the cutting head and the workpiece may then be controllably moved relative to the other of the cutting head and the workpiece to cut the workpiece as desired. Systems for generating high-pressure waterjets are currently available, such as, for example, the Mach 4 five-axis waterjet cutting system manufactured by Flow International Corporation. Other examples of waterjet cutting systems are shown and described in Flow's U.S. Pat. No. 5,643,058, which is incorporated herein by reference in its entirety.

Abrasive waterjet cutting systems are advantageously used when cutting workpieces made of particularly hard materials to meet exacting standards. However, the use of abrasives increases the cost of processing a workpiece with a waterjet cutting system. Consumption of abrasives may account for close to 50% of the total running cost of a given abrasive waterjet cutting system. Thus, attempts have been made to develop systems and methods that reduce the amount of abrasive consumed while processing a workpiece.

One method of reducing the consumption of abrasives is to recycle abrasives after they are used to process a workpiece a first time and use the recycled abrasives to process the workpiece an additional time. Known approaches for recycling abrasives are described in U.S. Pat. No. 6,299,510, which is incorporated herein by reference in its entirety. One known method of recycling abrasives used in a fluid jet cutting system to process a workpiece includes collecting the abrasives from a catcher tank into which an abrasive fluid jet dissipates after processing the workpiece. After collection, the abrasives may be dried and then sieved to separate those abrasives that retained their original size from those that fractured or otherwise reduced in size as a result of processing the workpiece. The separated abrasive particles that retained their original size are then used again to form an abrasive fluid jet and process a workpiece.

However, these known methods are limited in their ability to reduce consumption and cost of abrasive as any of the abrasives that are reduced in size after their first use are lost. Thus, a need exists for systems and methods that reduce abrasive consumption by increasing the percentage of used abrasives that are recycled while minimizing the impact these recycled abrasives have on cutting performance.

BRIEF SUMMARY

After abrasives are used to form an abrasive fluid jet and process a workpiece some of the abrasives may remain largely unchanged (e.g., having their original size and shape), while others of the abrasives will have a size, shape, or size and shape that differs from their original size and shape. The abrasives may erode or fracture due to the abrasive jet formation or due to impact with the workpiece. As the size of the abrasive particles reduces, the cutting power for those abrasive particles also reduces.

Thus an abrasive water jet system that recycles and reuses used abrasive particles may adjust one or more of the operating parameters of the system to compensate for the reduced cutting power of the recycled abrasive particles while maintaining a consistent quality of the process (e.g., cutting) being performed on a workpiece.

According to one embodiment, a method of operating an abrasive fluid jet system includes providing a first plurality of abrasive particles that collectively have an initial weight, adding the first plurality of abrasive particles into a fluid jet to form an abrasive fluid jet, and processing a workpiece with the abrasive fluid jet. The method further includes capturing the first plurality of abrasive particles within a container, removing the first plurality of abrasive particles from the container, and combining a second plurality of abrasive particles with the first plurality of abrasive particles to form a combination of first and second pluralities of abrasive particles, wherein the combination of first and second pluralities of abrasive particles has a weight substantially equal to the initial weight. The method further includes adjusting one or more operating parameters of the abrasive fluid jet system to compensate for a reduction in cutting power of the combination of first and second pluralities of abrasive particles compared to the first plurality of abrasive particles prior to their addition to the fluid jet, and adding the combination of first and second pluralities of abrasive particles into the fluid jet to form the abrasive fluid jet.

Additional embodiments described herein provide a method of operating an abrasive fluid jet system includes providing fresh abrasive particles that collectively have an initial weight, adding the fresh abrasive particles into a fluid jet to form an abrasive fluid jet, processing a workpiece with the abrasive fluid jet thereby converting the fresh abrasives to used abrasive particles, and dissipating the abrasive fluid jet into a volume of fluid enclosed within a container. The method further includes removing the used abrasive particles from the container, adding fresh abrasive particles to the used abrasive particles to form mixed abrasive particles such that the mixed abrasive particles collectively have a weight substantially equal to the initial weight, and adding the mixed abrasive particles into a fluid jet to form a mixed abrasive fluid jet. The method further includes processing the workpiece with the mixed abrasive fluid jet thereby converting the mixed abrasives particles to used abrasive particles, and dissipating the mixed abrasive fluid jet into a volume of fluid enclosed within a container.

The method further includes repeating a cycle including: 1) removing the used abrasive particles from the container, 2) adding fresh abrasive particles to the used abrasive particles to form mixed abrasive particles that collectively have a weight substantially equal to the initial weight, 3) adding the mixed abrasive particles into a fluid jet to form a mixed abrasive fluid jet, 4) processing the workpiece with the mixed abrasive fluid jet thereby converting the mixed abrasives particles to used abrasive particles, and 5) dissipating the mixed abrasive fluid jet into a volume of fluid enclosed within a container, until an average size of the mixed abrasive particles reaches a steady state across consecutive cycles.

Additional embodiments described herein provide a method of operating an abrasive fluid jet system, the method comprising supplying a flow of fresh abrasive particles to a cutting head of the abrasive fluid jet system at a first flow rate, supplying a flow of used abrasive particles to the cutting head at a second flow rate, mixing the fresh abrasive particles and the used abrasive particles to form mixed abrasive particles, and adding the mixed abrasive particles to a fluid jet generated by the cutting head to form an abrasive fluid jet. The method further includes discharging the abrasive fluid jet from an outlet of the cutting head thereby converting the mixed abrasives into used abrasives, and processing one or more workpieces with the abrasive fluid jet. The method further includes collecting the used abrasive particles, directing the collected, used abrasive particles to the flow of used abrasive particles, and adjusting one or more operating parameters of the abrasive fluid jet system to compensate for a reduction in cutting power of the used abrasives as the used abrasive particles are continuously discharged from the outlet of the cutting head.

Additional embodiments described herein provide a method of operating an abrasive fluid jet system, the method includes providing an amount of fresh abrasive particles within a container that is communicatively coupled to a cutting head of the abrasive fluid jet system, supplying a flow of used abrasive particles to the container, mixing the fresh abrasive particles and the used abrasive particles to form mixed abrasive particles, and adding the mixed abrasive particles to a fluid jet generated by the cutting head to form an abrasive fluid jet. The method further includes discharging the abrasive fluid jet from an outlet of the cutting head thereby converting the mixed abrasives into used abrasives, and processing one or more workpieces with the abrasive fluid jet. The method further includes collecting the used abrasive particles that have been discharged from the outlet, directing the used abrasive particles that have been collected to the flow of used abrasive particles, and adjusting one or more operating parameters of the abrasive fluid jet system to compensate for a reduction in cutting power of the used abrasives as the used abrasive particles are continuously discharged from the outlet of the cutting head.

Additional embodiments described herein provide an abrasive fluid jet system including an abrasive feed container, a fresh abrasives feed communicatively coupled to the abrasive feed container, and a used abrasives feed communicatively coupled to the abrasive feed container. The system further includes a cutting head having: an orifice unit through which fluid passes to generate a fluid jet, a mixing chamber downstream of the orifice unit through which the fluid jet passes, the mixing chamber communicatively coupled to the abrasive feed container such that abrasives from the abrasive feed container travel to the mixing chamber where the abrasives are added to the fluid jet to form an abrasive fluid jet, and an outlet though which the abrasive fluid jet exits the cutting head. The system further includes a catcher tank containing a volume of fluid, the catcher tank positioned relative to the cutting head such that the abrasive fluid jet dissipates within the volume of fluid after exiting the outlet, and an abrasives conditioner that receives abrasives that are removed from the catcher tank, the abrasives conditioner communicatively coupled to the used abrasives feed, wherein the abrasives conditioner conditions the received abrasives prior to transfer of the received abrasives to the used abrasives feed.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

FIG. 10 is a table showing percentages of abrasive particles at various use cycles that make up a current cycle of mixed abrasive particles until a steady state is reached, according to one embodiment.

DETAILED DESCRIPTION

Figure 1:
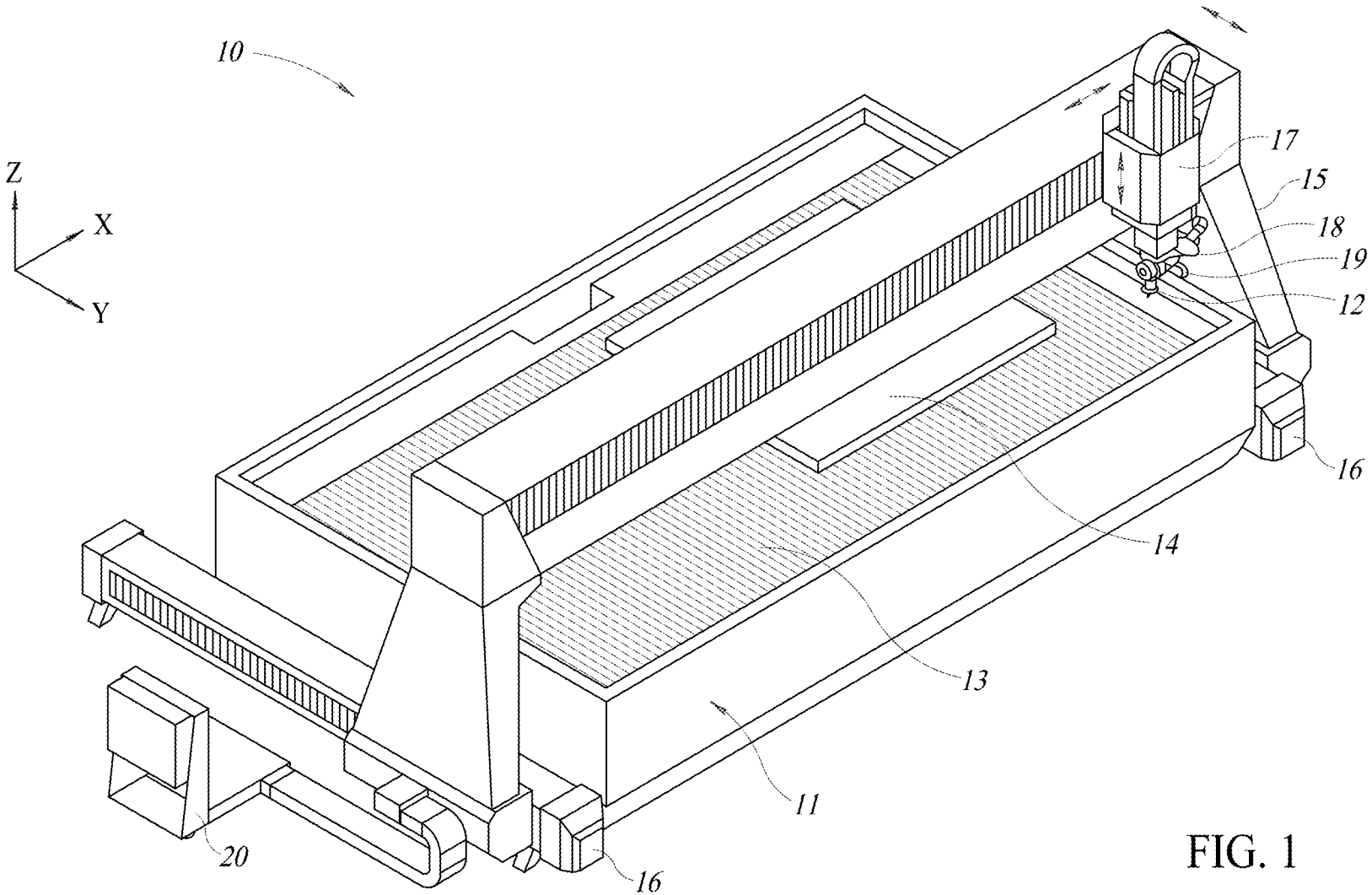
FIG. 1 is an isometric view of an abrasive fluid jet system, according to one embodiment.

In the following description, certain specific details are set forth to provide a thorough understanding of various disclosed embodiments. However, one skilled in the relevant art will recognize that embodiments may be practiced without one or more of these specific details, or with other methods, components, materials, etc. In other instances, well-known structures associated with high pressure waterjet systems have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. For example, certain features of the disclosure which are described herein in the context of separate embodiments may also be provided in combination in a single embodiment. Conversely, various features of the disclosure that are described in the context of a single embodiment may also be provided separately or in any subcombination.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise. Reference herein to two elements "facing" or "facing toward" each other indicates that a straight line can be drawn from one of the elements to the other of the elements without contacting an intervening solid structure.

Recitation of ranges of values herein are merely intended to serve as a shorthand method of referring individually to each separate value falling within the range including the stated ends of the range, unless otherwise indicated herein, and each separate value is incorporated into the specification as if it were individually recited herein.

Aspects of the disclosure will now be described in detail with reference to the drawings, wherein like reference numbers refer to like elements throughout, unless specified otherwise. Certain terminology is used in the following description for convenience only and is not limiting. The term "plurality", as used herein, means more than one. The terms "a portion" and "at least a portion" of a structure include the entirety of the structure. The term "cutting through" a structure refers to a complete removal of material through an entire thickness of the structure along the direction of impact of the cutting apparatus, for example the direction of travel of a waterjet just before it strikes a surface of the workpiece.

The headings and Abstract of the Disclosure provided herein are for convenience only and do not interpret the scope or meaning of the embodiments.

Referring to FIG. 1, an abrasive fluid jet system 10 (e.g., a system that generates a fluid jet to process (cut, drill, finish, etc.) a workpiece, such as a waterjet cutting system) may include a catcher tank assembly 11 having a work support surface 13 (e.g., an arrangement of slats) that is configured to support a workpiece 14 to be processed by the abrasive fluid jet system 10 (hereinafter "the system" or "the fluid jet system"). The fluid jet system 10 may further include a bridge assembly 15, which is movable along a pair of base rails 16 and straddles the catcher tank assembly 11. In operation, the bridge assembly 15 may move back and forth along the base rails 16 with respect to a translational axis X to position a cutting head assembly 12 of the system 10 that processes the workpiece 14.

A tool carriage 17 may be movably coupled to the bridge assembly 15 to translate back and forth along another translational axis Y, which is aligned perpendicularly to the aforementioned translational axis X. The tool carriage 17 may be configured to raise and lower the cutting head assembly 12 along yet another translational axis Z to move the cutting head assembly 12 toward and away from the workpiece 14 (and perpendicularly to both the translational axis X and the translational axis Y). One or more manipulable links or members may also be provided intermediate the cutting head assembly 12 and the tool carriage 17 to provide additional functionality.

As an example, the fluid jet system 10 may include a forearm 18 rotatably coupled to the tool carriage 17 to rotate the cutting head assembly 12 about an axis of rotation, and a wrist 19 rotatably coupled to the forearm 18 to rotate the cutting head assembly 12 about another axis of rotation that is nonparallel to the aforementioned rotational axis. In combination, the rotational axes of the forearm 18 and the wrist 19 can enable the cutting head assembly 12 to be manipulated in a wide range of orientations relative to the workpiece 14 to facilitate, for example, cutting of complex profiles. According to one embodiment, the system 10 may include a robotic arm (not shown), which carries the cutting head assembly 12 and is movable to position the cutting head assembly 12 relative to the workpiece 14, as desired.

The rotational axes may converge at a focal point which, in some embodiments, may be offset from the end or tip of a nozzle component of the cutting head assembly 12. The end or tip of the nozzle component of the cutting head assembly 12 may be positioned at a desired standoff distance from the workpiece 14 or work surface to be processed. The standoff distance may be selected or maintained at a desired distance to optimize the cutting performance of the waterjet. For example, in some embodiments, the standoff distance may be maintained at about 0.20 inch (5.1 mm) or less, or in some embodiments at about 0.10 inch (2.5 mm) or less. In other embodiments, the standoff distance may vary over the course of a trimming operation or during a cutting procedure, such as, for example, when piercing the workpiece.

In some instances, the nozzle component of the waterjet cutting head may be particularly slim or slender to enable, among other things, inclining of the nozzle component relative to the workpiece with minimal stand-off distance (e.g., a 30 degree inclination with standoff distance less than or equal to about 0.5 inch (12.7 mm)).

During operation, movement of the cutting head assembly 12 with respect to each of the translational axes and one or more rotational axes may be accomplished by various conventional drive components and an appropriate control system 20. The control system 20 may generally include, without limitation, one or more computing devices, such as processors, microprocessors, digital signal processors (DSP), application-specific integrated circuits (ASIC), and the like. To store information, the control system may also include one or more storage devices, such as volatile memory, non-volatile memory, read-only memory (ROM), random access memory (RAM), and the like. The storage devices can be coupled to the computing devices by one or more buses.

The control system may further include one or more input devices (e.g., displays, keyboards, touchpads, controller modules, or any other peripheral devices for user input) and output devices (e.g., display screens, light indicators, and the like). The control system 20 may store one or more programs for processing any number of different workpieces according to various cutting head movement instructions. The control system 20 may also control operation of other components, such as, for example, a secondary fluid source, a vacuum device and/or a pressurized gas source coupled to the pure waterjet cutting head assemblies and components described herein.

The control system 20, according to one embodiment, may be provided in the form of a general purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to, among other things, routing high-pressure water through the waterjet cutting systems described herein, providing a flow of secondary fluid to adjust or modify the coherence of a discharged fluid jet and/or providing a pressurized gas stream to provide for unobstructed pure waterjet cutting of a fiber reinforced polymer composite workpiece.

Further example control methods and systems for waterjet cutting systems, which include, for example, CNC functionality, and which are applicable to the waterjet cutting systems described herein, are described in Flow's U.S. Pat. No. 6,766,216, which is incorporated herein by reference in its entirety. In general, computer-aided manufacturing (CAM) processes may be used to efficiently drive or control a waterjet cutting head along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a waterjet cutting system to manipulate the cutting head about various translational and/or rotational axes to cut or process a workpiece as reflected in the CAD model.

Details of the control system, conventional drive components and other well-known systems associated with waterjet cutting systems, however, are not shown or described in detail to avoid unnecessarily obscuring descriptions of the embodiments. Other known systems associated with waterjet cutting systems include, for example, a high-pressure fluid source (e.g., direct drive and intensifier pumps with pressure ratings ranging from about 60,000 psi to 110,000 psi and higher) to supply high-pressure fluid to the cutting head assembly 12.

According to some embodiments, the fluid jet system 10 may include a pump, such as, for example, a direct drive pump or intensifier pump (not shown), to selectively provide pressurized fluid (e.g., water) at an operating pressure of at least 10,000 psi (e.g., between about 10,000 psi and about 110,000 psi). The cutting head assembly 12 of the fluid jet system 10 may be configured to receive the pressurized fluid supplied by the pump and to generate a pressurized fluid jet (e.g., a waterjet) to process workpieces. A fluid distribution system (not shown) in fluid communication with the pump and the cutting head assembly 12 may be provided to assist in routing pressurized fluid from the pump to the cutting head assembly 12.

Figure 2:
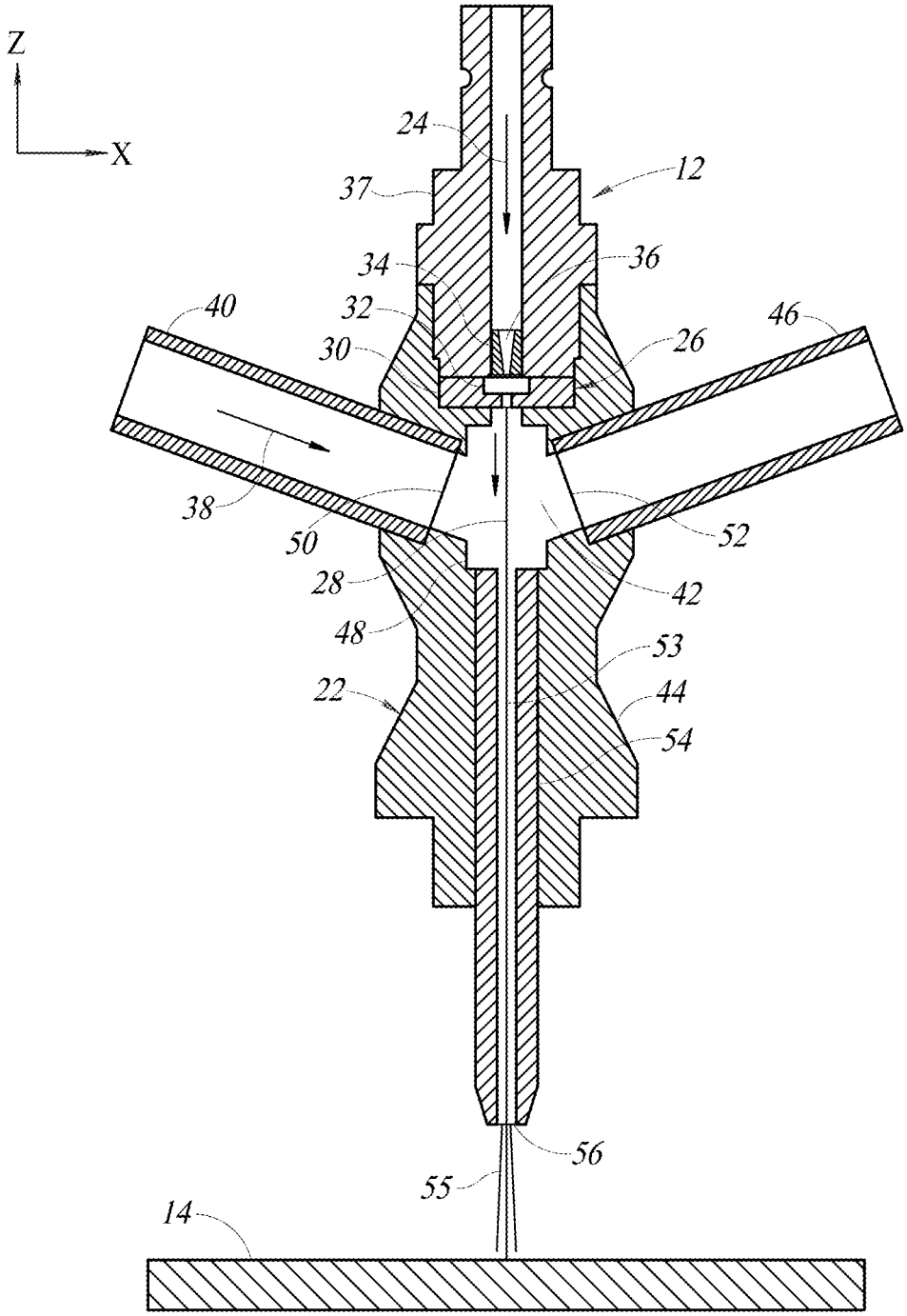
FIG. 2 is a side, cross-sectional view of a cutting head assembly of the abrasive fluid jet system illustrated in FIG. 1, according to one embodiment.

Referring to FIG. 2, the cutting head assembly 12 may include a nozzle 22. The nozzle 22 may be operable with ultrahigh pressure fluid (e.g., equal to or greater than about 80,000 psi (551 MPa)), high pressure fluid (e.g., between about 50,000 psi (345 MPa) and about 80,000 psi (551 MPa)), medium pressure fluid (e.g., between about 30,000 psi (206 MPa) and about 50,000 psi (345 MPa)), low pressure fluid (e.g., between about 10,000 psi (69 MPa) and about 30,000 psi (206 MPa)), or combinations thereof.

Pressurized fluid 24 from a source (e.g., the pump) advances into the nozzle 22. The system 10 may include a jet generating assembly 26 that generates a fluid jet 28. The jet generating assembly 26 may include an orifice mount 30 and an orifice unit 32. In some embodiments, the nozzle 22 may include a seal assembly 34. The seal assembly 34 may have a passageway 36 that tapers inwardly in the downstream direction so as to direct the pressurized fluid 24 into and through the orifice unit 32.

As shown, the jet generating assembly 26 may produce the fluid jet 28 from the pressurized fluid 24 flowing through a feed conduit 37 of the nozzle 22. The orifice unit 32 may produce the fluid jet 28 in which an abrasive 38, flowing through an abrasive port 40 of the nozzle 22, is added (e.g., entrained) at a mixing region 42 (e.g., a mixing chamber). According to one embodiment, the cutting head assembly 12 may produce a pure water jet (i.e., one devoid of abrasives), and the system 10 may therefore be devoid of the abrasive port 40.

Various types of orifice units or other fluid jet producing devices can be used to achieve the desired flow characteristics of the fluid jet 28. The orifice mount 30 may be fixed with respect to a cutting head body 44 and include a recess (e.g., a disk-shaped recess) dimensioned to receive and to hold the orifice unit 32.

The configuration and size of the orifice mount 30 may be selected based on the desired position of the orifice unit 32. According to one embodiment, the orifice mount 30 may be disk-shaped and removably retained by the cutting head body 44, enabling removal and replacement of the orifice mount 30 as it approaches the end of its life cycle.

The nozzle 22 may include an auxiliary port 46 that provides passage for the introduction of a second substance or to allow the nozzle 22 to be connected to a pressurization source (e.g., a vacuum source, pump, etc.) or one or more sensors (e.g., pressure sensors). U.S. Publication No. 2003/0037650 and U.S. Pat. Nos. 6,875,084 and 5,643,058 disclose methods and devices that can be used with the ports 40, 46. U.S. Publication No. 2003/0037650 and U.S. Pat. Nos. 6,875,084 and 5,643,058 are incorporated by reference herein in their entireties.

The cutting head body 44, may have a one-piece construction formed via a machining process (e.g., an injection molding process). The cutting head body 44 may be made, in whole or in part, of one or more metals (e.g., steel, aluminum, titanium, etc.) or metal alloys, according to one embodiment. The cutting head body 44 having a one-piece construction may result in the cutting head body 44 being less prone to malfunction.

As shown, an inner surface 48 of the cutting head body 44 may define the mixing region 42, an abrasive inlet 50 of the abrasive port 40, and an auxiliary inlet 52 of the auxiliary port 46. The abrasives 38 passing through the abrasive inlet 50 may be entrained in the fluid jet 28 as it passes through the mixing region 42. Entraining can include, without limitation, mixing, combining, or otherwise bringing together two or more different substances. For example, abrasives may be partially or fully mixed with the fluid forming the fluid jet such that the fluid jet carries the abrasives into and through a mixing tube 54, thereby forming an abrasive fluid jet 55. According to one embodiment, the abrasives 38 may make up less than 15% of the abrasive fluid jet 55 by volume.

The cutting head body 44 may include a recess sized to receive the mixing tube 54. According to one embodiment, the pressurized fluid 24 from the pump may be delivered to the jet generating assembly 26. The orifice unit 32 produces the fluid jet 28 that passes through the mixing region 42. To form the abrasive fluid jet 55, the abrasives 38 delivered through the abrasive port 40 and into the mixing region 42 via the abrasive inlet 50, may be combined together and delivered through a channel 53 of the mixing tube 54. The abrasives 38 and the fluid jet 28 may be further mixed in the mixing tube 54 to produce the abrasive fluid jet 55, which exits via an outlet 56 of the nozzle 22 (e.g., a distal end of the mixing tube 54) and is directed to the workpiece 14 to process the workpiece 14.

The components of the cutting head assembly 12, such as mixing tubes, orifice units, and orifice mounts may be selected based on the operating parameters, such as working pressures, cutting action, and the like. The system 10 may include a valve assembly that selectively controls the flow of the pressurized fluid 24 into the nozzle 22. U.S. Publication No. 2003/0037650, incorporated by reference herein, discloses various types of valve assemblies that can be used with the illustrated nozzle 22. Other types of valve assemblies can also be used with the nozzle 22, if needed or desired.

Figure 3:
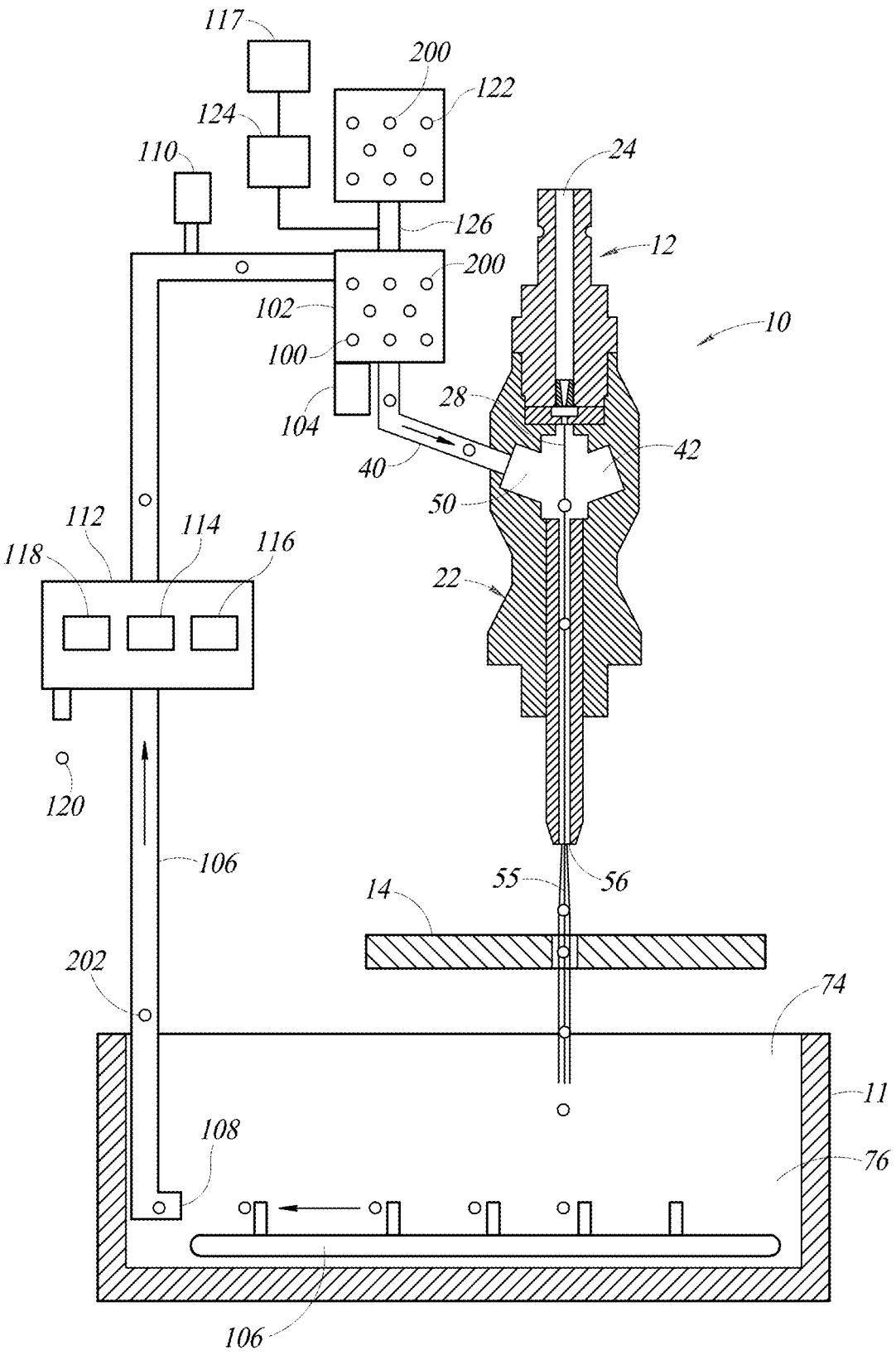
FIG. 3 is a side, cross-sectional view of an abrasive fluid jet system according to one embodiment.
Figure 4:
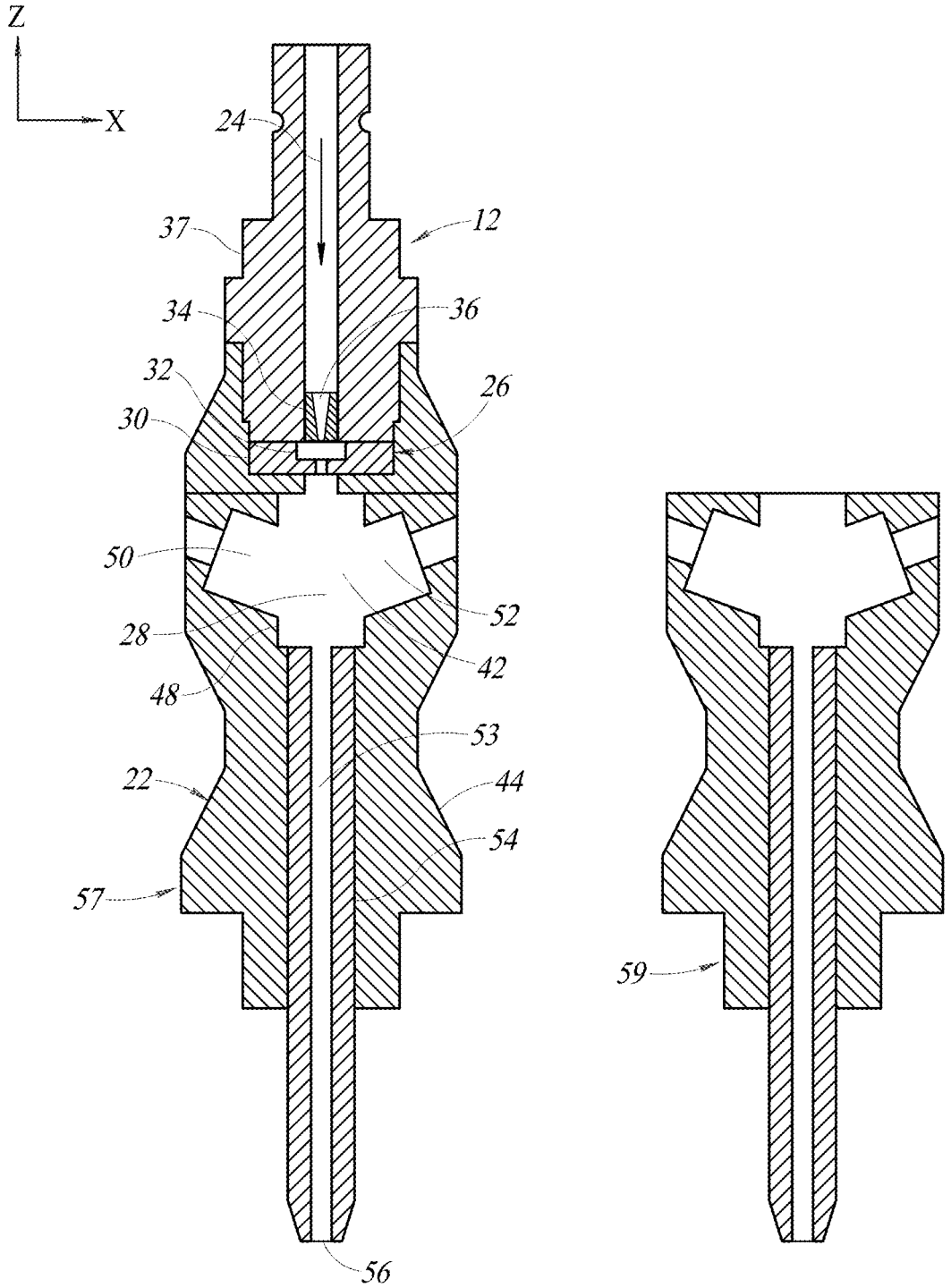
FIG. 4 is a side, cross-sectional view of a cutting head assembly of the abrasive fluid jet system according to one embodiment.

Referring to FIGS. 2 to 4, a method of operating an abrasive fluid jet system (e.g., the system 10) may include providing a first plurality of abrasive particles 100 (e.g., within a container such as an abrasive feed hopper 102) that is communicatively coupled to the nozzle 22 (e.g., the mixing region 42). It will be understood that abrasive particles are illustrated within the drawings at a greatly exaggerated size for clarity. The first plurality of abrasive particles 100, collectively, may have an initial amount (e.g., an initial weight such as 100 lbs.). The system 10 may include a scale 104 that determines the initial weight of the first plurality of abrasive particles 100.

The method may further include adding the first plurality of abrasive particles 100 into the fluid jet 28 to form the abrasive fluid jet 55. As shown the first plurality of abrasive particles 100 may be transferred (e.g., via the abrasive port 40) from the abrasive feed hopper 102 to the mixing region 42. The first plurality of abrasives 100 may be transferred and added to the fluid jet 28 at a flow rate that is adjustable. According to one embodiment the first plurality of abrasives 100 may be entrained (e.g., via vacuum assist) into the fluid jet 28.

The method may further include processing the workpiece 14 with the abrasive fluid jet 55. The method may further include capturing the first plurality of abrasive particles 100 within a container (e.g., the catcher tank assembly 11), which may be positioned relative to the nozzle 22 such that after the abrasive fluid jet 55 exits the outlet 56 and processes the workpiece 14, the abrasive fluid jet 55 enters and dissipates within a volume of fluid 74 contained within the catcher tank assembly 11.

The method may include removing the first plurality of abrasive particles 100 from the catcher tank assembly 11. According to one embodiment, the removal of the first plurality of abrasive particles 100 may be manual (e.g., via a person using a scoop or shovel). According to one embodiment, the removal may be automated by the system 10 (e.g., via a conveyor 106 with an inlet 108 positioned within the volume of fluid 74). The system 10 may include a vacuum source 110 to assist in the removal of the first plurality of abrasive particles 100 from the volume of fluid 74, and the transport of the first plurality of abrasive particles 100 along the conveyor 106. The catcher tank assembly 11 may include a current within the volume of fluid 74 that flows toward the inlet 108.

The system 10 may include a conditioner 112 that prepares the first plurality of abrasive particles 100 for reuse in a second cycle through the nozzle 22. The conditioner 112 may include a separator 114 that separates abrasives (e.g., the first plurality of abrasive particles 100) from other particles (e.g., particulate matter from the workpiece 14 produced by impingement of the abrasive fluid jet 55 with the workpiece 14. The method may include separating the first plurality of abrasive particles 100 from other particulate matter.

The conditioner 112 may include a dryer 116 that reduces the moisture content of the abrasives (e.g., the first plurality of abrasive particles 100). According to one embodiment, the dryer removes the fluid 74 from the first plurality of abrasive particles 100. The method may include drying the first plurality of abrasive particles 100 after the first plurality of abrasive particles 100 are removed from the catcher tank assembly 11.

According to one embodiment, the conditioner may include a sizer 118 (e.g., a sieve) that separates ones of the first plurality of abrasive particles 100 that are below a certain size from ones of the first plurality of abrasive particles 100 that are above the certain size. The method may include removing a portion of the first plurality of abrasive particles 100 from a remainder of the first plurality of abrasive particles 100, wherein the first plurality of abrasive particles of the portion are below a predetermined size.

As the first plurality of abrasive particles 100 are used to form the abrasive fluid jet 55, a size of a number of the first plurality of abrasive particles 100 will be reduced, especially when impacting the workpiece 14 while processing the workpiece 14. Those of the first plurality of abrasive particles 100 that are reduced in size will similarly have a reduced cutting power if used in future cycles to once again form the abrasive fluid jet 55. The reduction in size for some of the first plurality of abrasive particles 100 may be so significant as to result in the cutting power of those particles being negligible. The sizer 118 may be adjustable such that the certain size is selectable to coincide with the material of the first plurality of abrasive particles 100 and the size at which that material's cutting power is negligible. Particles 120 separated by the separator 114 and the sizer 118 may be removed from the system 10.

For example, the material for the first plurality of abrasive particles 100 may be garnet. The garnet particles, prior to use in the formation of the abrasive fluid jet 55, may have an average size of between about 50 mesh and 220 mesh. Depending upon the processing operation, garnet particles with a size below about 250 mesh may be no longer suitable for use in the formation of the abrasive fluid jet 55, and thus the sizer 118 may be set to remove those particles that are below 250 mesh in size.

The method may include combining a second plurality of abrasive particles 122 with the first plurality of abrasive particles 100 to form a combination of first and second pluralities of abrasive particles 100, 122. According to one embodiment, the second plurality of abrasive particles 122 may be the same as the first plurality of abrasive particles 100 prior to their use in the formation of the abrasive fluid jet 55. For example both the first plurality of abrasive particles 100 and the second plurality of abrasive particles 122 may be garnet particles with an average size of between 50 mesh and 220 mesh. According to one embodiment, the second plurality of abrasive particles 122 may be the different than the first plurality of abrasive particles 100 (e.g., same material but different size, same size but different material, or different size and different material).

After all of the first plurality of abrasive particles 100 have been used in the formation of the abrasive fluid jet 55, removed from the catcher tank assembly 11, and readied for reuse in another cycle to once again form the abrasive fluid jet 55 (e.g., via placement within the abrasive feed hopper 102), the amount (e.g., weight) of the collective first plurality of abrasive particles 100 may have decreased. The decrease may be the result of loss during handling of the particles, and/or due to losses based on the size of some of the particles no longer being sufficient to increase the cutting power of the fluid jet 28.

Thus, the method may include combining an amount of the second pluralities of abrasive particles 122 to the first plurality of abrasive particles 100 such that the combination has an amount equal to the initial amount (e.g., the initial weight). For example, if the initial amount was 100 lbs. of the first plurality of abrasive particles 100, and 90 lbs. of the first plurality of abrasive particles 100 are returned to the abrasive feed hopper 102 (e.g., as determined by the scale 104), 10 lbs. of the second plurality of abrasive particles 122 may be added to the abrasive feed hopper 102. The system 10 may include one or more controllers 124 that control the addition of the second plurality of abrasive particles 122 to the first plurality of abrasive particles 100 (e.g., via actuation of a valve 126).

The method may further include adjusting one or more operating parameters of the system 10 (e.g., via the one or more controllers 124) to compensate for a reduction in cutting power of the combination of first and second pluralities of abrasive particles 100, 122 compared to the first plurality of abrasive particles 100 prior to their use in the formation of the abrasive fluid jet 55. As discussed above, abrasive particles may get smaller as they are used in the formation of the abrasive fluid jet 55, thus those particles that are returned to the abrasive feed hopper 102 at the end of a cycle may have a collective cutting power that is less than that of the first plurality of abrasive particles 100 prior to their use.

The one or more operating parameters may include fluid pressure (i.e., pressure of the fluid 24 that passes through the orifice unit 32 to form the fluid jet 28. The one or more parameters may include cutting speed (i.e., a speed at which the cutting head assembly 12 translates relative to a fixed point (e.g., the workpiece 14, the catcher tank assembly 11, etc.). The one or more parameters may include a flow rate at which abrasive particles are added to the fluid jet 28 (e.g., 1 lb./min.).

According to one implementation, adjusting the one or more operating parameters of the system 10 may include increasing the fluid pressure, decreasing the cutting speed, increasing the flow rate, or any combination thereof. As the abrasive particles are continuously cycled and their cutting power decreases, the adjustments to the one or more operating parameters may be made to maintain a consistent cut quality. However, according to another implementation adjusting the one or more parameters may include decreasing the fluid pressure, increasing the cutting speed, decreasing the flow rate, or any combination thereof, if the method includes increasing cutting power of the abrasive particles (e.g., by starting with a fresh batch of abrasives). The adjustment of the one or more operating parameters may be performed during operation of the cutting head assembly 12 (e.g., while continuously generating the fluid jet 28).

The one or more operating parameters may include an orifice size of the orifice unit 32 through which the fluid 24 passes to generate the fluid jet 28. The one or more operating parameters may include a diameter of the mixing tube 54 through which the abrasive fluid jet 55 passes. The one or more operating parameters may include a length of the mixing tube 54. The adjustment of the one or more operating parameters may be performed during downtime of the system 10 (e.g., while generation of the fluid jet 28 is discontinued).

According to one embodiment, adjusting the one or more operating parameters may include changing one or more components of the system 10 (e.g., one or more components of the cutting head assembly 12). For example, the orifice unit 32 having a first orifice size may be replaced with another of the orifice unit 32 having a second orifice size, different from the first orifice size.

According to one embodiment, the cutting head assembly 12 may include a cartridge (e.g., a first cartridge 57 as shown in FIG. 4) that is replaceable. The first cartridge 57 may include the mixing tube 54, such that replacing the first cartridge 57 with a second cartridge 59 may result in changing one or more physical characteristics of the system 10, for example the mixing tube 54 (e.g., length, cross-sectional area, etc.). Other components of the first cartridge 57 may be identical with those of the second cartridge 59 such that both the first cartridge 57 and the second cartridge 59 may be swapped and used as part of the system 10 with minimal adjustment needed.

Thus, according to one embodiment, adjusting one or more operating parameters of the system 10 may include replacing the first cartridge 57 with the second cartridge 59. The respective one of the first cartridge 57 and the second cartridge 59 may be coupled to the cutting head assembly 12 via fasteners (e.g., bolts, screws, etc.), adhesives, friction fit, tongue and groove, magnets, etc.

After combining the second pluralities of abrasive particles 122 with the first plurality of abrasive particles 100, the combination of the first and second pluralities of abrasive particles 100, 122 may be mixed to provide an even distribution of the first and second pluralities of abrasive particles 100, 122. The method may include adding the combination of first and second pluralities of abrasive particles 100, 122 to a fluid jet (e.g., the fluid jet 28) to form an abrasive fluid jet (e.g., the abrasive fluid jet 55).

According to one embodiment, the method may include a cycle in which abrasives (e.g., the first plurality of abrasive particles 100) are added to a fluid jet to form an abrasive fluid jet, recovered, and readied for use another time in the formation of an abrasive fluid jet. The method may include another cycle in which the combination of the first and second pluralities of abrasive particles 100, 122 go through the same steps as the first plurality of abrasive particles 100 as described above.

Upon completion of the second cycle, a third plurality of abrasive particles (e.g., another batch of the second plurality of abrasive particles) may be added to the combination of first and second pluralities of abrasive particles 100, 122 such that a combination of the first, second, and third pluralities of abrasive particles has an amount (e.g., weight) equal to the initial amount. This new combination of the first, second, and third pluralities of abrasive particles may have a further reduced cutting power compared to the combination of first and second pluralities of abrasive particles. Thus, the method may include once again adjusting the one or more operating parameters of the system 10. The adjusting may include another iteration of the same adjustments made previously (e.g., fluid pressure may be increased by 2 percent after each cycle). According to one embodiment, the various instances of adjustments may vary from cycle to cycle.

According to one embodiment, the first plurality of abrasive particles 100 may, prior to their addition to the fluid jet 28 to form the abrasive fluid jet 55, be fresh abrasive particles 200 (i.e., abrasive particles that have not been used previously to form an abrasive fluid jet). After completion of a cycle in which the fresh abrasive particles have been used to form the abrasive fluid jet 55, the first plurality of abrasive particles 100 are used 202 abrasive particles. The second plurality of abrasive particles 122 may, prior to their addition to the fluid jet 28 to form the abrasive fluid jet 55, be fresh abrasive particles (i.e., abrasive particles that have not been used previously to form an abrasive fluid jet). The addition or combination of the fresh and used abrasive particles forms mixed abrasive particles 200, 202.

Accordingly, a method of operating an abrasive fluid jet system (e.g., the system 10) may include providing fresh abrasive particles 100 that collectively have an initial amount (e.g., an initial weight) and adding the fresh abrasive particles 200 into the fluid jet 28 to form the abrasive fluid jet 55. The method may include processing one or more workpieces 14 with the abrasive fluid jet 55 thereby converting the fresh abrasive particles 200 to used abrasive particles 202. The method may include dissipating the abrasive fluid jet 55 into the volume of fluid 74 enclosed within a container (e.g., the catcher tank assembly 11), and removing the used abrasive particles 202 from the container.

The method may include adding additional fresh abrasive particles 200 to the used abrasive particles 202 (e.g., within the abrasive feed hopper 102) to form mixed abrasive particles 200, 202 such that the mixed abrasive particles 200, 202 collectively have an amount (e.g., weight) equal to the initial amount. The method may include adding the mixed abrasive particles 200, 202 into a fluid jet (e.g., the fluid jet 28) to form a mixed abrasive fluid jet (e.g., the abrasive fluid jet 55), and processing the one or more workpieces 14 with the mixed abrasive fluid jet thereby converting the mixed abrasives particles 200, 202 to used abrasive particles 202, and dissipating the mixed abrasive fluid jet into the volume of fluid 74 enclosed within the container.

The method may further include repeating a cycle. The cycle may include removing the used abrasive particles 202 from the container, adding additional fresh abrasive particles 200 to the used abrasive particles 202 to form mixed abrasive particles 200, 202 that collectively have an amount equal to the initial amount, adding the mixed abrasive particles 200, 202 into a fluid jet (e.g., the fluid jet 28) to form a mixed abrasive fluid jet (e.g., the abrasive fluid jet 55), processing the one or more workpieces 14 with the mixed abrasive fluid jet thereby converting the mixed abrasives particles 200, 2020 to used abrasive particles 202, and dissipating the mixed abrasive fluid jet into the volume of fluid 74 enclosed within the container. According to one embodiment the method may include repeating the cycle until an average size of the mixed abrasive particles 200, 202 reaches a steady state across consecutive cycles.

According to one embodiment, the average size of the steady state mixed abrasives may be about seventy-five percent of the average size of the fresh abrasives. According to one embodiment, the average size of the steady state mixed abrasives may be about fifty percent of the average size of the fresh abrasives.

The cycle of the method may include, prior to adding the mixed abrasive particles 200, 202 into the fluid jet 28 to form the mixed abrasive fluid jet 55, adjusting one or more of the operating parameters of the abrasive fluid jet system 10 to compensate for a reduction in cutting power of the mixed abrasive particles 200, 202 of the current cycle compared to the mixed abrasive particles 200, 202 of the previous cycle. The cycle of the method may include, after removing the used abrasive particles 202 from the container and prior to adding fresh abrasive particles 200 to the used abrasive particles 202 to form the mixed abrasive particles 200, 202, drying the used abrasive particles 202.

The cycle of the method may include, after removing the used abrasive particles 202 from the container and prior to adding fresh abrasive particles 200 to the used abrasive particles 202 to form the mixed abrasive particles 200, 202, weighing the used abrasive particles 202. The cycle of the method may include, after removing the used abrasive particles 202 from the container and prior to adding fresh abrasive particles 200 to the used abrasive particles 202 to form the mixed abrasive particles 200, 202, removing a portion of the used abrasive particles 202 from a remainder of the abrasive particles 202, wherein used abrasive particles of the portion are each below a predetermined size.

Figure 5:
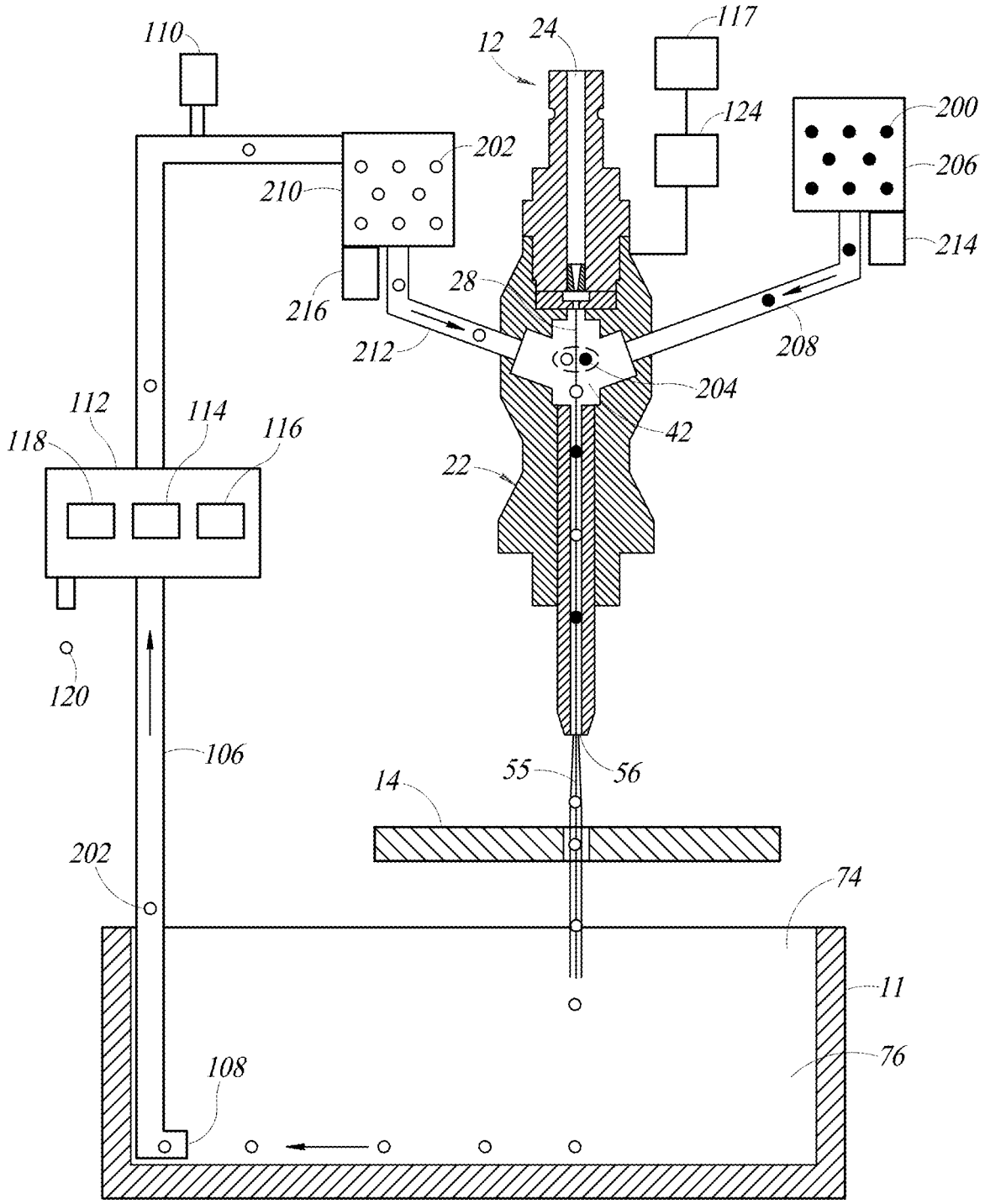
FIG. 5 is side, cross-sectional view of an abrasive fluid jet system according to one embodiment.

Referring to FIG. 5, a method of operating an abrasive fluid jet system (e.g., the system 10) may include supplying a flow of fresh abrasive particles 200 to the cutting head assembly 12 at a first flow rate. The method may further include supplying a flow of used abrasive particles to the cutting head assembly 12 at a second flow rate simultaneously while supplying the flow of fresh abrasive particles 200 to the cutting head assembly 12.

The method may further include mixing the fresh abrasive particles 200 and the used abrasive particles 202 to form mixed abrasive particles 204. The mixing of the fresh abrasive particles 200 and the used abrasive particles 202 may take place in the mixing region 42. As shown, the system 10 may include a fresh abrasive feed hopper 206 that contains and supplies the flow of fresh abrasive particles 200 through a first port 208, and a used abrasive feed hopper 210 that contains and supplies the flow of used abrasive particles 202 through a second port 212 that is separate from the first port 208. According to another embodiment, the fresh abrasive particles 200 and the used abrasive particles 202 may be mixed prior to entering the mixing region 42, and the mixed abrasive particles 204 may be delivered through a single port (e.g., the first port 208).

The method may include adding the mixed abrasive particles 204 to the fluid jet 28 generated by the cutting head assembly 12 to form the abrasive fluid jet 55. The method may include discharging the abrasive fluid jet 55 from the outlet 56 of the cutting head assembly 12 thereby converting the mixed abrasives 204 into used abrasives 202. The method may include processing one or more of the workpieces 14 with the abrasive fluid jet 55.

The method may include collecting the used abrasive particles 202 and directing the collected, used abrasive particles 202 to the flow of used abrasive particles (e.g., to the source for the flow of the used abrasive particles 202, which may be the used abrasive feed hopper 210 as shown in the illustrated embodiment. Similar to the method described in reference to FIG. 3, the method may include adjusting one or more of the operating parameters of the system 10 to compensate for a reduction in cutting power of the used abrasives particles 202 as the used abrasive particles 202 are continuously discharged from the outlet 56 of the cutting head assembly 12 over an increasing number of cycles.

The method may include adjusting the one or more operating parameters of the system 10 at regularly spaced intervals of time. The method may include terminating the adjusting of the one or more operating parameters of the system 10 upon an average size of the mixed abrasive particles 204 reaching a steady state.

According to one embodiment of the method, the second flow rate (of the used abrasive particles 202) may be greater than the first flow rate (of the fresh abrasive particles 200). The first and second flow rates may be controlled by respective first and second metering devices 214, 216. Adjustment of the one or more operating parameters may include changing the first flow rate, the second flow rate, or both the first flow rate and the second flow rate. According to one embodiment, both the first flow rate and the second flow rate are adjusted while maintaining the same total flow rate (the first flow rate plus the second flow rate). According to one embodiment, both the first flow rate and the second flow rate are adjusted while varying the total flow rate.

According to one embodiment, the first flow rate, the second flow rate, or both the first flow rate and the second flow rate may be adjusted by the one or more controllers 124.

According to one embodiment, the second flow rate is at least two times greater than the first flow rate. According to one embodiment, the second flow rate is at least four times greater than the first flow rate. According to one embodiment, the second flow rate is at least eight times greater than the first flow rate. According to one embodiment, the first flow rate is greater than the second flow rate.

Similar to the method described in reference to FIG. 3, the method may include, after processing the one or more workpieces 14 with the abrasive fluid jet 55, dissipating the abrasive fluid jet 55 in the volume of fluid 74 enclosed within a container (e.g., the catcher tank assembly 11). The method may include removing the used abrasive particles 202 from the volume of fluid 74 and drying the used abrasive particles 202 (e.g., with the dryer 116 of the conditioner 112). The method may include removing a portion of the used abrasive particles 202 from a remainder of the used abrasive particles 202, wherein the used abrasive particles 202 of the portion are below a predetermined size (e.g., via the sizer 118).

Figure 6:
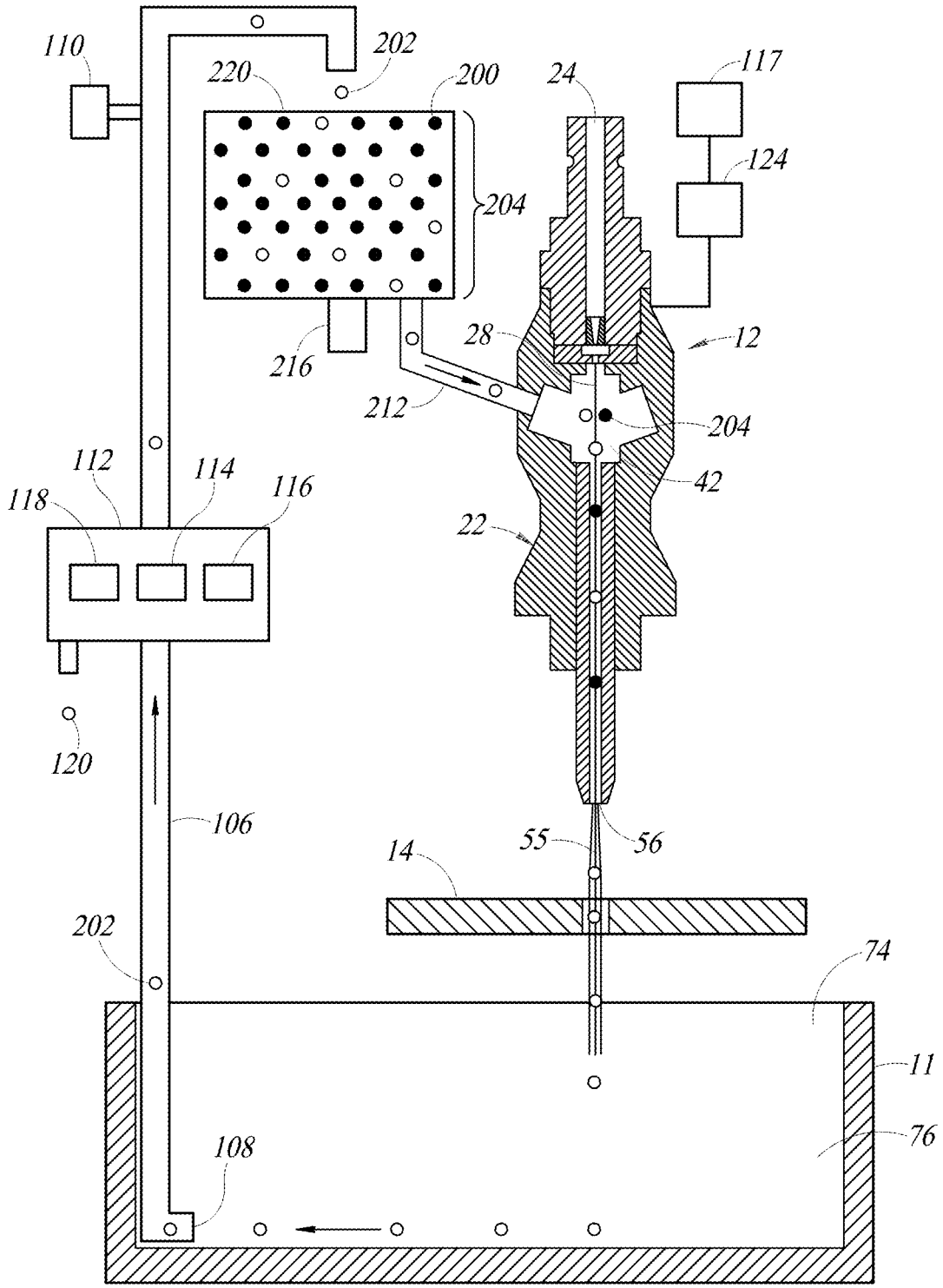
FIG. 6 is a side, cross-sectional view of an abrasive fluid jet system according to one embodiment.

Referring to FIG. 6, a method of operating an abrasive fluid jet system (e.g., the system 10) is similar to the method described in reference to FIG. 5 except as highlighted below. As shown, the system 10 may include one abrasive feed hopper 220. According to one embodiment, the method may include providing a batch of the fresh abrasive particles 200 within the abrasive feed hopper 220. After the fresh abrasives 200 go through a cycle, in which they form an abrasive fluid jet (e.g., the abrasive fluid jet 55), they are returned as used abrasive particles to the abrasive feed hopper 220.

The abrasive feed hopper 220 may include a mixer that evenly distributes the used abrasive particles 202 within the fresh abrasive particles 200 to form the mixed abrasive particles 204 within the abrasive feed hopper 220. The method may include avoiding adding any additional fresh abrasive particles 200 beyond the initial batch, such that the mixed abrasive particles 204 will have a higher concentration of used abrasive particles 202 and a lower concentration of fresh abrasive particles 200 over time. Additionally, the amount of abrasive particles within the system 10 may decrease over time as abrasive particles are lost or discarded (e.g., by the sizer 118) and no new abrasive particles are added. Thus steady state may never be reached, and the one or more operating parameters of the system 10 may be adjusted throughout the method and only terminated upon termination of the method, which may restart when an entire batch of fresh abrasive particles are once again added to the abrasive feed hopper 220.

Figure 7:
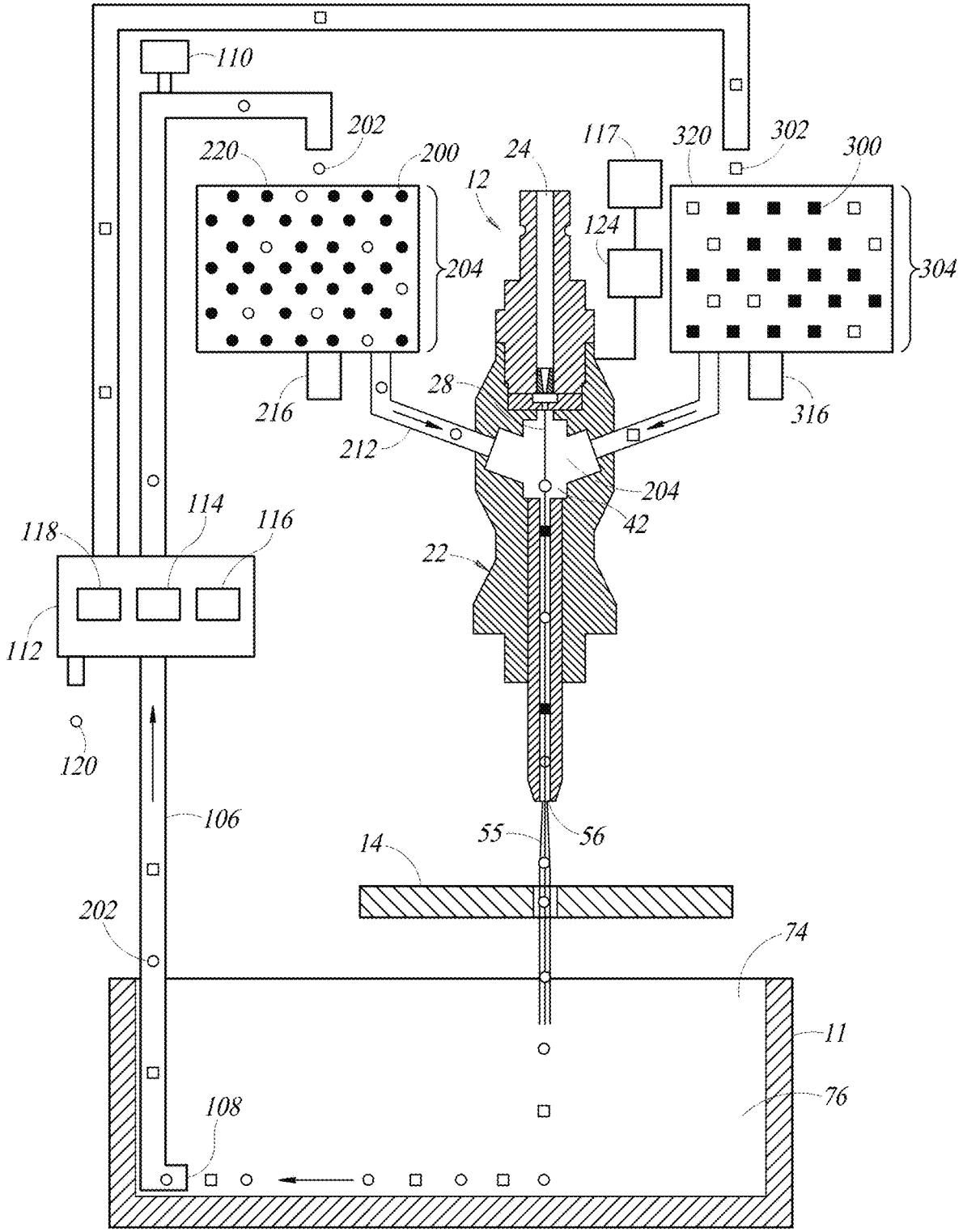
FIG. 7 is a side, cross-sectional view of an abrasive fluid jet system according to one embodiment.

Referring to FIG. 7, the system 10 may recycle multiple (e.g., two or more) different types of abrasive particles. The different types of abrasive particles may include one or more "soft" abrasives (e.g., having a hardness in a range of about 6 to 7 on the Mohs scale, such as garnet, silica, glass, etc.) and one or more "hard" abrasives (e.g., having a hardness in a range of about 8 to 9 on the Mohs scale, such as aluminum oxide or silicon carbide) The different types of abrasives may also include one that is denser than another. For example garnet with specific gravity of about 4 and steel grit with specific gravity of about 8.

The system 10 may be operable to supply zero, one, or more than one of the different types of abrasive particles to the fluid jet (e.g., as described in U.S. Pat. No. 8,308,525 the disclosure of which is hereby incorporated in its entirety). When zero of the different types of abrasive particles are supplied, the system 10 produces a pure waterjet (i.e., one that is devoid of abrasive particles). When one of the different types of abrasive particles are supplied, the system 10 produces an abrasive waterjet that may be selected based on the material of the workpiece 14 (e.g., a soft abrasive being supplied when cutting softer materials, and a hard abrasive being supplied when cutting harder materials). When two or more of the different types of abrasive particles are supplied, the system 10 produces a blended abrasive waterjet that may be tailored based on the material(s) of the workpiece 14 (e.g., transitioning from a first ratio of soft/hard abrasives to a second ratio of soft/hard abrasives).

When multiple different types of abrasive particles are collected at within the catcher tank assembly 11, the system 10 (e.g., the conditioner 112) may separate the used abrasive particles 202 based on their type of material. Separation may occur based on size, shape, weight, or any combination thereof. Each of the different type of used abrasive particles may then be diverted and delivered to a respective abrasive feed hopper.

A method of operating an abrasive fluid jet system (e.g., the system 10) is similar to the method described in reference to FIG. 6 with differences highlighted below. As shown, the system 10 may include at least two abrasive feed hoppers (e.g., the abrasive feed hopper 220, referred to as a first abrasive feed hopper, and a second abrasive feed hopper 320. According to one embodiment, the method may include providing a batch of the first fresh abrasive particles 200 within the first abrasive feed hopper 220 and providing a batch of second fresh abrasive particles 300 within the second abrasive feed hopper 320

After one or both of the first and second fresh abrasives 200, 300 go through a cycle, in which they form an abrasive fluid jet (e.g., the abrasive fluid jet 55), they are returned as used abrasive particles 202, 302 to the respective abrasive feed hopper 220, 320. The abrasive feed hopper 320 may include a mixer that evenly distributes the used abrasive particles 302 within the fresh abrasive particles 300 to form the mixed abrasive particles 304 within the abrasive feed hopper 320.

The method may include avoiding adding any additional fresh abrasive particles 300 beyond the initial batch, such that the mixed abrasive particles 304 will have a higher concentration of used abrasive particles 302 and a lower concentration of fresh abrasive particles 300 over time. Additionally, the amount of abrasive particles within the system 10 may decrease over time as abrasive particles are lost or discarded (e.g., by the sizer 118) and no new abrasive particles are added. Thus steady state may never be reached, and the one or more operating parameters of the system 10 may be adjusted throughout the method and only terminated upon termination of the method, which may restart when an entire batch of fresh abrasive particles are once again added to the abrasive feed hoppers 220, 320.

The method may include adjusting the one or more operating parameters of the system 10 (e.g., at regularly spaced intervals of time). The method may include terminating the adjusting of the one or more operating parameters of the system 10 upon an average size of the mixed abrasive particles 204, 304 reaching a steady state.

According to one embodiment of the method, a first flow rate of the first abrasive particles 200, 202, 204 and a second flow rate of the second abrasive particles 300, 302, 304 may be controlled by the one or more controllers 124 (e.g., via respective metering devices 216, 316). Adjustment of the one or more operating parameters may include changing the first flow rate, the second flow rate, or both the first flow rate and the second flow rate. According to one embodiment, both the first flow rate and the second flow rate are adjusted while maintaining the same total flow rate (the first flow rate plus the second flow rate). According to one embodiment, both the first flow rate and the second flow rate are adjusted while varying the total flow rate.

Figure 8:
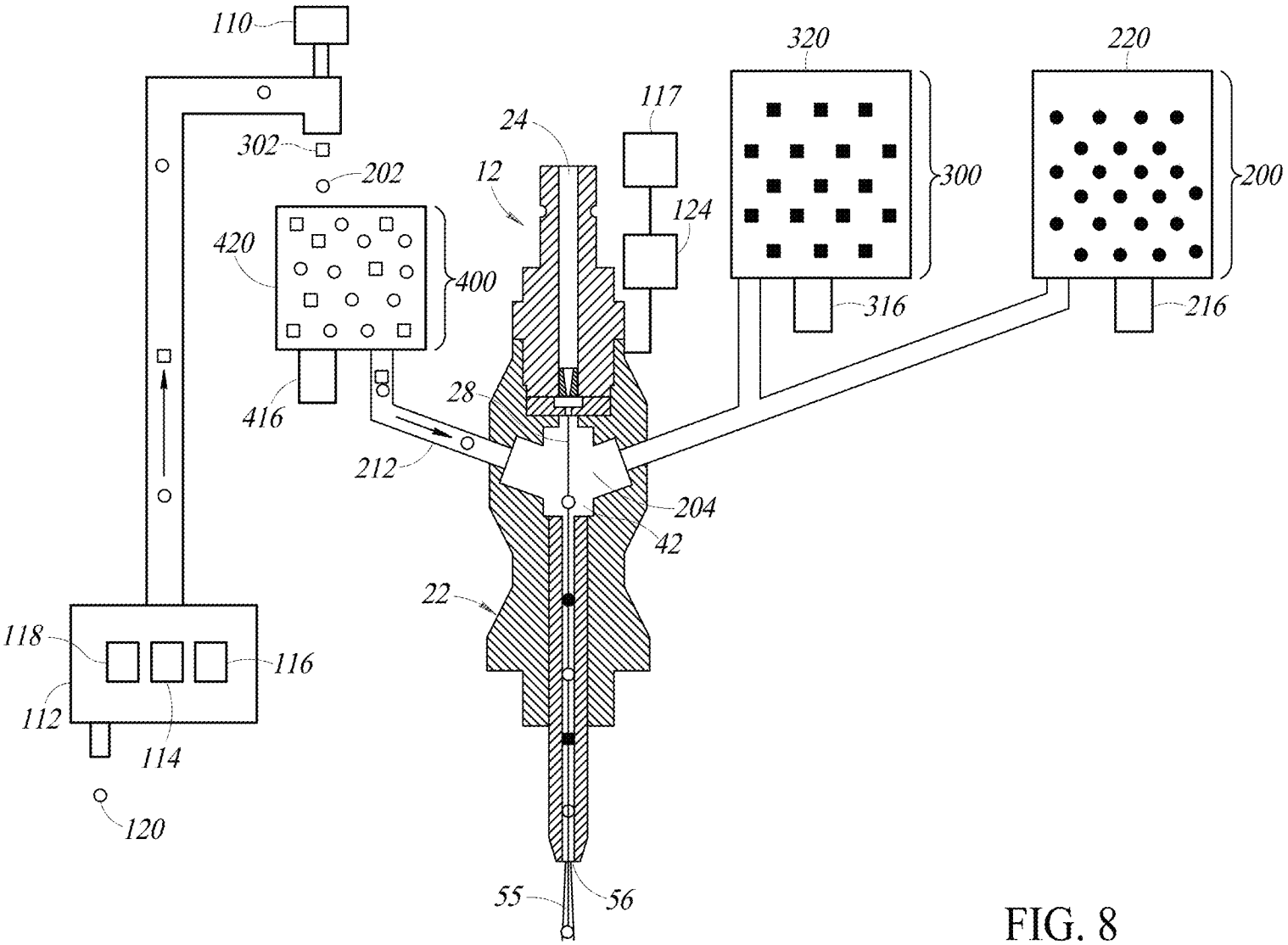
FIG. 8 is a side, cross-sectional view of a portion of an abrasive fluid jet system according to one embodiment.

Referring to FIG. 8, the system 10 may recycle multiple (e.g., two or more) different types of abrasive particles using components similar to those described above. Portions of the system 10 are not illustrated in FIG. 8 (e.g., the catcher tank assembly 11 and the workpiece 14 so as to not obfuscate the features of the embodiment described in detail below). Rather than separating the used abrasive particles 202, 302 into separate respective streams to be delivered to separate material feed hoppers, the used abrasive particles 202, 302 may be blended after exiting the conditioner 112 and delivered to a blended material feed hopper 420 to form blended, used abrasive particles 400.

The system 10 may be operable to supply the first fresh abrasive particles 200, the second fresh abrasive particles 300, the blended, used abrasive particles 400, or any combination thereof. According to one embodiment of the method, flow rates may be controlled by the one or more controllers 124 (e.g., via respective metering devices 216, 316, 416). Adjustment of the one or more operating parameters may include changing the first flow rate (of the first abrasive particles 200), the second flow rate (of the second fresh abrasive particles 300), the third flow rate (of the blended, used abrasive particles 400) or any combination thereof. According to one embodiment, one or more of the first, second, and third flow rates are adjusted while maintaining the same total flow rate (the first flow rate plus the second flow rate plus the third flow rate). According to one embodiment, one or more of the flow rates may be adjusted while varying the total flow rate.

A method of operating an abrasive fluid jet system (e.g., the system 10) is similar to the method described in reference to FIG. 6 with differences highlighted below. As shown, the system 10 may include at least three abrasive feed hoppers (e.g., the first abrasive feed hopper 220, the second abrasive feed hopper 320, and the blended material feed hopper 420. According to one embodiment, the method may include providing a batch of the first fresh abrasive particles 200 within the first abrasive feed hopper 220 and providing a batch of second fresh abrasive particles 300 within the second abrasive feed hopper 320.

The blended material feed hopper 420 may include a mixer that evenly distributes the first and second used abrasive particles 202, 302 to form the blended, used abrasive particles 400 within the blended material feed hopper 420.

Referring to FIGS. 3 to 8, the system 10 may include a database 117 that stores machinability numbers for one or more abrasive materials at various numbers of use cycles. For example, the database 117 may include machinability numbers for garnet at various numbers of use cycles including, but not limited to: a first cycle, which is prior to the garnet being used to process a workpiece as part of an abrasive waterjet; a second cycle, which is after the garnet is used one time to process a workpiece as part of an abrasive waterjet; a third cycle, which is after the garnet is used two times to process a workpiece as part of an abrasive waterjet; a fourth cycle, which is after the garnet is used three times to process a workpiece as part of an abrasive waterjet; and so on.

The database 117 may include multiple tables of machinability numbers that factor in different operating conditions (e.g., the material of the workpiece 14, pressure of the fluid 24, etc.) According to one embodiment, the database 117 may include tables that include machinability numbers for blends of multiple abrasive materials, including different materials (e.g., hard, soft, more dense, and less dense abrasives) at a same number of uses/cycles (e.g., each of the two or more abrasive materials at zero uses "fresh" or at one or more uses "used" or "recycled") or at different number of uses/cycles (e.g., a first, harder, and/or more dense, abrasive material at zero uses "fresh" and a second, soft, and/or less dense, abrasive material at one previous use "used" or "recycled").

Any of the methods described herein may include the controller 124 adjusting one or more operating parameters of the abrasive fluid jet system 10 based on the machinability numbers in the database that correspond to the abrasives being added to the fluid jet 28 and the current use cycle of the abrasives. For example, as abrasive particles go through multiple uses/cycles, their machinability number may change, leading to a change (increase or decrease) in one or more of the operating parameters (e.g., an increase in fluid pressure that forms the fluid jet 28, a change in a speed of the processing of the workpiece 14) to maintain a steady processing performance of the system 10 on the workpiece 14 (such as a consistent surface finish) while using recycled abrasive particles. According to one embodiment, the one or more parameters of the system 10 may be adjusted based on the transitioning ratio of soft/hard or more dense/less dense abrasives.

Figure 9:
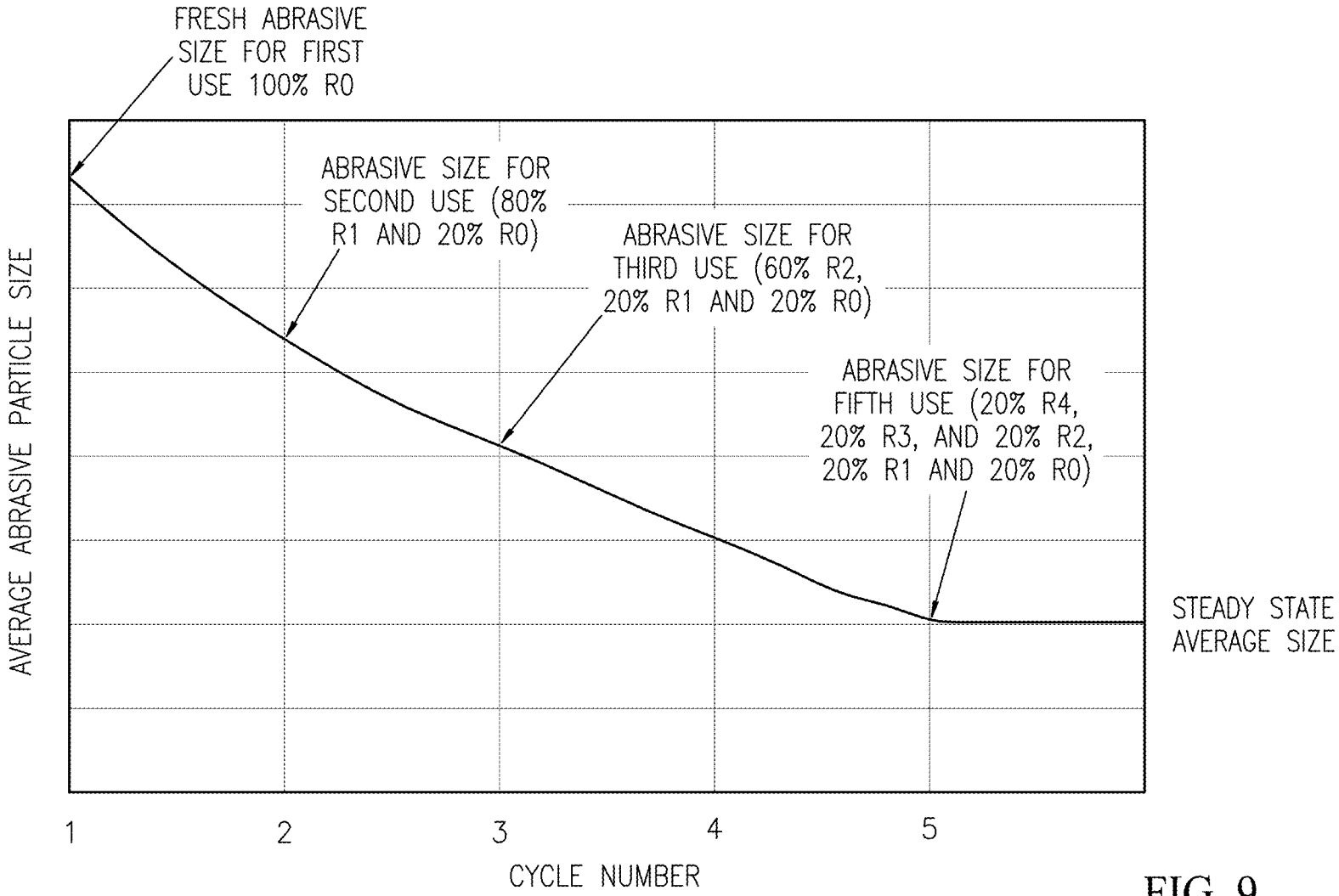
FIG. 9 is a graph comparing average abrasive particle size to number of cycles in which the abrasive particles have been used in the formation of an abrasive water jet, according to one embodiment.

Referring to FIG. 9, as described above when recycling abrasive particles, the size (and sometimes the shape) of some of the abrasive particles will change every time they are used (recycled) until a steady state condition is reached. The abrasive particles of the second use (first recycle) may have a different size distribution from the abrasive particles in the third use (second recycle) and so on. As shown in the example of FIG. 9, a portion of the abrasive particles lost (e.g., due to significant breakdown or by handling) is 20%. Thus, at the start of each cycle 20% fresh abrasives may be added.

The continuing decrease in size of the repeatedly used abrasive particles results in each new mix of recycled abrasives and fresh abrasives having a new size distribution until the steady state is reached. As shown in FIG. 9, with a 20% loss of used abrasive particles (and thus a 20% addition of fresh abrasive particles) five cycles are needed to reach steady state (the size distribution of the abrasive particles of the sixth cycle will be equal to the size distribution of the abrasive particles of the fifth cycle).

Referring to FIG. 10, the table provided demonstrates a method of use in which the number of cycles to reach steady state is ten. On the tenth cycle, the abrasive particles include abrasive particles that have been recycled up to nine times with 10% of each level of use. Other numbers of cycles may be used to reach steady state based on the material of the abrasive particles and other operating parameters of the system 10.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The various embodiments described above can be combined to provide further embodiments.

Many of the methods described herein can be performed with variations. For example, many of the methods may include additional acts, omit some acts, and/or perform acts in a different order than as illustrated or described.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of operating an abrasive fluid jet system, the method comprising:

providing a first plurality of abrasive particles that collectively have an initial weight;

adding the first plurality of abrasive particles into a fluid jet to form an abrasive fluid jet;

processing a workpiece with the abrasive fluid jet;

capturing the first plurality of abrasive particles within a container;

removing the first plurality of abrasive particles from the container;

combining a second plurality of abrasive particles with the first plurality of abrasive particles to form a combination of first and second pluralities of abrasive particles, wherein the combination of first and second pluralities of abrasive particles has a weight substantially equal to the initial weight;

adjusting one or more operating parameters of the abrasive fluid jet system to compensate for a change in cutting power of the combination of first and second pluralities of abrasive particles compared to the first plurality of abrasive particles prior to their addition to the fluid jet; and adding the combination of first and second pluralities of abrasive particles into the fluid jet to form the abrasive fluid jet.

2. The method of claim 1 wherein the container encloses a volume of fluid, the method further comprising:

drying the first plurality of abrasive particles after the first plurality of abrasive particles are removed from the container and before combining the second plurality of abrasive particles with the first plurality of abrasive particles.

3. The method of claim 1, further comprising:

weighing the first plurality of abrasive particles after removing the first plurality of abrasive particles from the container and before combining the second plurality of abrasive particles with the first plurality of abrasive particles.

4. The method of claim 1, further comprising:

prior to combining the second plurality of abrasive particles with the first plurality of abrasive particles to form the combination of first and second pluralities of abrasive particles, removing a portion of the first plurality of abrasive particles from a remainder of the first plurality of abrasive particles, wherein the first plurality of abrasive particles of the portion are below a predetermined size.

5. The method of claim 4 wherein the predetermined size is a threshold below which a cutting power of the first plurality of abrasive particles is negligible.

6. The method of claim 1, further comprising:

capturing the combination of first and second pluralities of abrasive particles within the container; and removing the combination of first and second pluralities of abrasive particles from the container.

7. The method of claim 1, further comprising:

generating the fluid jet with a cutting head of the abrasive fluid jet system; and generating the abrasive fluid jet with the cutting head of the abrasive fluid jet system.

8. The method of claim 1 wherein the first plurality of abrasive particles are a same material as the second plurality of abrasive particles.

9. The method of claim 1 wherein:

after removing the first plurality of abrasive particles from the container, the first plurality of abrasive particles have a first average size; and prior to combining the second plurality of abrasive particles with the first plurality of abrasive particles, the second plurality of abrasive particles have a second average size, and the second average size is greater than the first average size.

10. The method of claim 9 wherein:

prior to adding the first plurality of abrasive particles into the fluid jet, the first plurality of abrasive particles have a third average size that is equal to the second average size.

11. The method of claim 1 wherein:

the one or more operating parameters include: a fluid pressure that forms the fluid jet and the abrasive fluid jet, cutting speed at which the fluid jet and the abrasive fluid jet translate relative to the workpiece, and flow rate at which the first plurality of abrasive particles are added into the fluid jet and at which the combination of first and second pluralities of abrasive particles are added into the abrasive fluid jet; and adjusting the one or more operating parameters of the abrasive fluid jet system includes: increasing the fluid pressure that forms the abrasive fluid jet compared to the fluid jet, decreasing the cutting speed at which the abrasive fluid jet translates compared to the cutting speed of the fluid jet, increasing the flow rate of the combination of first and second pluralities of abrasive particles compared to the flow rate of the first plurality of abrasive particles, or any combination thereof.

12. The method of claim 11 further comprising:

adjusting the one or more operating parameters of the abrasive fluid jet system while continuously: 1) adding the combination of first and second pluralities of abrasive particles into the abrasive fluid jet, and 2) processing the workpiece with the abrasive fluid jet.

13. The method of claim 1 wherein:

the one or more operating parameters include: an orifice size through which a fluid passes to generate the abrasive fluid jet, a mixing tube diameter through which the abrasive fluid jet passes, and a length of the mixing tube.

14. The method of claim 1, further comprising:

after adding the combination of first and second pluralities of abrasive particles into the fluid jet to form the abrasive fluid jet, combining a third plurality of abrasive particles with the combination of first and second pluralities of abrasive particles to form a combination of first, second, and third pluralities of abrasive particles, wherein the combination of first, second, and third pluralities of abrasive particles has a weight substantially equal to the initial weight;

adjusting the one or more operating parameters of the abrasive fluid jet system to compensate for a reduction in cutting power of the combination of first, second, and third pluralities of abrasive particles compared to the combination of first and second pluralities of abrasive particles prior to their addition to the fluid jet; and adding the combination of first, second, and third pluralities of abrasive particles into the fluid jet to form a second abrasive fluid jet.

15. The method of claim 1, further comprising:

removing a batch of abrasive particles from the container, wherein the batch includes an amount of the first plurality of abrasive particles, an amount of abrasive particles made of a first material, and an amount of abrasive particles made of a second material, wherein the first material is different from the second material; and prior to combining the first plurality of abrasive particles with the second plurality of abrasive particles to form the combination of first and second pluralities of abrasive particles, separating the amount of abrasive particles made from the first material from the amount of abrasive particles made from the second material.

16. The method of claim 1, further comprising:

removing a batch of abrasive particles from the container, wherein the batch includes an amount of the first plurality of abrasive particles, an amount of abrasive particles made of a first material, and an amount of abrasive particles made of a second material, wherein the first material is different from the second material; and prior to combining the first plurality of abrasive particles with the second plurality of abrasive particles to form the combination of first and second pluralities of abrasive particles, blending the amount of abrasive particles made from the first material with the amount of abrasive particles made from the second material to form the second plurality of abrasive particles.

* * * * *